US010612297B2

(12) United States Patent
Bibens et al.

(10) Patent No.: US 10,612,297 B2
(45) Date of Patent: Apr. 7, 2020

(54) WINDOW AND SYSTEM OF WINDOWS COMPRISING AN ACOUSTIC DAMPING DEVICE

(71) Applicant: SAPA BUILDING SYSTEMS FRANCE, Toulouse (FR)

(72) Inventors: Philippe Bibens, Toulouse (FR); Patrick Lahbib, Ramonville (FR); Maxime Keller, Colomiers (FR)

(73) Assignee: HYDRO BUILDING SYSTEMS FRANCE, Toulouse (FR)

( * ) Notice: Subject to any disclaimer, the term of this patent is extended or adjusted under 35 U.S.C. 154(b) by 0 days.

(21) Appl. No.: 15/568,483

(22) PCT Filed: Apr. 21, 2016

(86) PCT No.: PCT/FR2016/050929
§ 371 (c)(1),
(2) Date: Oct. 23, 2017

(87) PCT Pub. No.: WO2016/170274
PCT Pub. Date: Oct. 27, 2016

(65) Prior Publication Data

US 2018/0298675 A1 Oct. 18, 2018

(30) Foreign Application Priority Data

Apr. 21, 2015 (FR) ..... 15 53566
Jun. 12, 2015 (FR) ..... 15 55414
Apr. 20, 2016 (FR) ..... 16 53476

(51) Int. Cl.
*E06B 5/20* (2006.01)
*E06B 3/263* (2006.01)
(Continued)

(52) U.S. Cl.
CPC ..... *E06B 5/205* (2013.01); *E06B 3/26347* (2013.01); *E06B 5/20* (2013.01);
(Continued)

(58) Field of Classification Search
CPC ..... E06B 5/205; E06B 3/26347; E06B 7/28; G10K 11/17823; G10K 2210/12; G10K 2210/3044; G10K 2210/3046
(Continued)

(56) References Cited

U.S. PATENT DOCUMENTS 4,425,739 A * 1/1984 Garbell ..... E06B 5/205 454/196
5,379,824 A * 1/1995 Carvalho ..... E06B 3/2605 160/44
(Continued)

FOREIGN PATENT DOCUMENTS

DE 100 52 093 A1 5/2002
DE 10052093 * 2/2005
(Continued)

OTHER PUBLICATIONS

Joo, WO 00/79087, 2000.*

*Primary Examiner* — William A Jerez Lora
(74) *Attorney, Agent, or Firm* — Im IP Law; Chai Im; C. Andrew Im

(57) ABSTRACT

A sliding window to close off an open surface in a wall separating the inside from the outside. The window includes an opening panel, a frame and a passive acoustic silencer. The silencer includes two parallel and acoustically absorbent slides extending in a median plane normal to the open surface. One slide is attached to the opening panel and the other slide is attached to the frame. The movement of the opening panel relative to the frame creating, between the slides, a slit having a thickness equal to the window opening.
(Continued)

Also, a system of windows to acoustically damp between the inside and outside of an open space in a wall.

25 Claims, 3 Drawing Sheets

(51) Int. Cl.
*G10K 11/178* (2006.01)
*G10K 11/16* (2006.01)
*G10K 11/168* (2006.01)
*E06B 7/28* (2006.01)

(52) U.S. Cl.
CPC ..... *E06B 7/28* (2013.01); *G10K 11/161* (2013.01); *G10K 11/168* (2013.01); *G10K 11/178* (2013.01); *G10K 11/17823* (2018.01); *G10K 2210/12* (2013.01); *G10K 2210/3044* (2013.01); *G10K 2210/3046* (2013.01)

(58) Field of Classification Search
USPC ..... 381/56, 58, 71.1, 71.7, 71.8
See application file for complete search history.

(56) References Cited

U.S. PATENT DOCUMENTS

| | | | | |
|---|---|---|---|---|
| 6,285,773 | B1 | 9/2001 | Carme et al. | |
| 9,551,180 | B2 * | 1/2017 | Xu | E06B 7/00 |
| 2004/0008857 | A1 * | 1/2004 | Marnie | H04R 1/20 381/397 |
| 2007/0223714 | A1 | 9/2007 | Nishikawa | |
| 2010/0266138 | A1 | 10/2010 | Sachau et al. | |
| 2012/0012561 | A1 * | 1/2012 | Wiryadinata | B23K 9/0956 219/108 |
| 2012/0155669 | A1 | 6/2012 | Carme | |
| 2016/0068112 | A1 * | 3/2016 | Price | B60R 11/0217 381/86 |
| 2018/0320922 | A1 * | 11/2018 | Carme | G10K 11/178 |
| 2018/0320925 | A1 * | 11/2018 | Carme | F24F 13/18 |

FOREIGN PATENT DOCUMENTS

| | | | |
|---|---|---|---|
| EP | 1 199 438 | A2 | 4/2002 |
| FR | 2 766 650 | A1 | 1/1999 |
| WO | 00/79087 | A1 | 12/2000 |
| WO | 2011/020977 | A2 | 2/2011 |

* cited by examiner

WINDOW AND SYSTEM OF WINDOWS COMPRISING AN ACOUSTIC DAMPING DEVICE

RELATED APPLICATIONS

This application is a § 371 application from PCT/FR2016/050929 filed Apr. 21, 2016, which claims priority from French Patent Application No. 15 53566 filed Apr. 21, 2015, No. 15 55414 filed Jun. 12, 2015 and No. 16 53476 filed Apr. 20, 2016 each of which is incorporated herein by reference in its entirety.

TECHNICAL FIELD

The invention concerns a system of windows for acoustic damping. The invention pertains to the field of openings, more particularly but not exclusively that of windows or window frames used to close the openings made in the façade of a building.

BACKGROUND OF THE INVENTION

The use of a multi-pane window, created from precise and dimensionally stable technical profiles to make the opening panel and the frame of said window, makes it possible to achieve perfect tightness of that window and an elevated soundproofing factor when the window is closed.

However, if the opening panel of such windows is even slightly ajar this soundproofing is significantly impaired. This is especially unpleasant for apartments or offices located in noisy streets or near traffic routes, especially in the upper stories where the effect of noise abatement walls is reduced. Thus, the occupants of such premises cannot open their windows for more than a few minutes without experiencing the effects of outside noise in an intolerable manner.

Document US 2010/0266138 describes one example of active noise control in a closed room. This type of active control requires the installation of loudspeakers in the room and an optimization of their placement. Also, this device of the prior art is not suitable for use by the public at large.

OBJECT AND SUMMARY OF THE INVENTION

The invention proposes to solve the inadequacies of the prior art and accordingly it concerns a window, especially a sliding window, blocking an open surface in a wall separating the inside from the outside, and comprising a opening panel and a frame, characterized in that it comprises:

a passive acoustic silencer comprising two acoustically absorbent parallel slides, extending in a median plane normal to the open surface, one of them being secured to the opening panel and the other being secured to the frame, the displacement of the opening panel with respect to the frame creating between said slides a gap with a thickness equal to the opening of the window.

Thus, the gap created upon opening the window produces an acoustic dampener for noise lying at frequencies between around 1000 Hz and 5000 Hz. The slides are adapted to being fitted onto any existing window, more particularly but not exclusively a window with an opening panel.

The invention is advantageously carried out by the embodiments and variants explained below, which should be considered individually or in any technically feasible combination.

Advantageously, the slides are each comprised of a U-shaped profile applied against the body of the opening panel or frame and filled with an acoustic absorbent material. This embodiment is easy to produce. The nature of the profile is adapted to the nature of the window body.

According to one exemplary embodiment, the slides extend by 25 cm in the direction normal to the open surface. This configuration is a good compromise between the efficiency of the device according to the invention and its esthetic impact on the window.

According to one advantageous embodiment, the window according to the invention comprises an active acoustic damping system comprising:

a loudspeaker placed in one of the slides;

a microphone;

an electronic control module comprising means of analyzing the signal picked up by the microphone and generating a signal emitted by the loudspeaker constituting an acoustic counterwave to the signal picked up by the microphone.

Thus, the active damping system complements the passive damping system for frequencies below 1000 Hz.

According to a first embodiment, the microphone is placed in the slide connected to the opening panel and the loudspeaker is placed in the slide connected to the frame. Thus, the active damping system is comprised in the slides such that the device according to the invention is adaptable to every existing window.

According to an alternative or supplemental embodiment, the window according to the invention comprises a microphone secured to the frame on the inside. Thus placed, this microphone picks up in precise fashion the outdoor noise coming into the inside. The proximity of this microphone to the interior end of the acoustic silencer allows it to pick up a signal filtered by that silencer and improves the efficiency of the active acoustic processing.

According to variant embodiments, the window according to the invention comprises a loudspeaker secured to the opening panel and turned toward the outside, or a loudspeaker connected to the opening panel and turned toward the gap between the two slides, these two variants not being mutually exclusive of each other.

Advantageously, the window according to the invention comprises a plurality of loudspeakers. Thus, the emission of the contrary acoustic signal is optimized by directing this signal toward the loudspeakers adapted as a function of the frequency ranges.

Also, according to one exemplary embodiment of the window according to the invention, a plurality of loudspeakers is able to emit a signal in a frequency interval extending below 250 Hz and a plurality of loudspeakers is adapted to emit an acoustic signal of frequency higher than 250 Hz.

Advantageously, the loudspeakers are spaced apart by an interval less than or equal to half wavelength of the highest frequency f of the active damping effectiveness. Thus, the number of high-volume loudspeakers designed for low frequencies is reduced.

Advantageously, the inventive window comprises a plurality of microphones. This measure allows a more precise capture of the acoustic field. Advantageously, the microphones of said plurality are spaced by an interval less than or equal to half wavelength corresponding to the maximum frequency f of the active damping effectiveness.

The invention likewise concerns a method for the damping of outside noise in an interior room comprising a window according to the invention, which method involves the steps of:

picking up the outside noise with the aid of a microphone;

generating an acoustic wave contrary to the signal picked up in the frequency range between 80 Hz and 1000 Hz.

Thus, this method combines the passive damping for elevated frequencies and active damping for low frequencies, which allows it to be effective in attenuating the outdoor noise for window openings as large as 10 cm.

The invention likewise concerns a prefabricated assembly, or kit, comprising:

a slide, designed to be secured to the frame of a window, comprising a U-shaped profile filled with an acoustic absorbent material, and comprising a loudspeaker;

a slide, designed to be secured to the opening panel of a window, comprising a U-shaped profile filled with an acoustic absorbent material;

a microphone;

an electronic control module comprising computing means, means able to generate a signal going to the loudspeaker, and means of receiving the signal coming from the microphone;

means of electrical power supply of the electronic module.

This kit is adaptable to an existing window in order to improve its acoustic performance when partly ajar.

Advantageously, the kit according to the invention comprises:

photovoltaic means connected to the electrical power supply means.

Thus, the kit operates autonomously and does not need to be connected to the power mains.

The invention likewise concerns a system of windows, especially sliding windows, for acoustic damping, said system blocking an open space in a wall separating the inside from the outside, said open space comprising an open internal surface and an open external surface, and said system comprising a first window and a second window, each window comprising at least one opening panel, or end panel, cooperating with a portion of a frame. Moreover, the system is configured such that:

said first and second windows respectively block said internal and external surfaces, at least one of said first and second windows comprises at least one passive acoustic silencer comprising two parallel and acoustically absorbent slides, extending in a median plane normal to the internal and external surfaces, one of which is secured to said at least one end panel and the other is secured to the portion of the frame connected to said at least one end panel, the displacement of said at least one end panel with respect to the frame creating between said slides a gap with a thickness equal to the opening of the window.

Thus, the gap created during the opening of one of said first and second windows in the area of an end panel produces an acoustic dampener for noise at frequencies between around 1000 Hz and 5000 Hz. The slides are adapted to being fitted onto all existing windows, more particularly but not exclusively a window having at least one opening panel.

The system of windows is advantageously carried out by the embodiments and variants set forth below, which should be considered individually or in any technically feasible combination.

In one particular embodiment, at least one of said first and second windows comprises two end panels cooperating respectively with two distinct portions of its frame.

In one particular embodiment, each window comprises two end panels cooperating respectively with two distinct portions of the frame of that window. Such a configuration advantageously allows one to have respective openings of the first and second windows contained in identical median planes or distinct planes, according to the need for ventilation and/or noise reduction.

In one particular embodiment, the first and second windows comprise respectively a first and a second passive acoustic silencer, the slides of said first and second passive acoustic silencers extending respectively in two distinct median planes. Thus, when the windows are respectively open in two parallel and opposite directions, the path of the noise in penetrating from the outside to the inside constitutes a maze through said first and second passive acoustic silencers, so that the acoustic damping performance is clearly improved as compared to the use of one single window.

In one particular embodiment, the first and second windows respectively comprise a first and second passive acoustic silencer, the slides of said first and second passive acoustic silencers extending in a common median plane. This embodiment allows a good ventilation of the interior while ensuring an efficient acoustic damping which is improved as compared to the use of one single window.

In one particular embodiment, each window comprises a first and second passive acoustic silencer, the slides of the first passive acoustic silencer of the first window and of the first passive acoustic silencer of the second window respectively extending in a first common median plane, the slides of the second passive acoustic silencer of the first window and of the second passive acoustic silencer of the second window respectively extending in a second common median plane, said first and second common median planes being different. This embodiment makes it possible to realize advantageously all possible configurations of opening and acoustic damping according to the need for ventilation of the interior and noise reduction.

In one particular embodiment, said system comprises at least one intermediate opening panel positioned between said two end panels of the same window. This configuration makes it possible to adapt the size of the first and second windows to large open spaces and/or to increase the number of openings.

In one particular embodiment, at least one passive acoustic silencer of the system of windows also comprises an active acoustic damping system comprising:

a loudspeaker placed in one of the slides of said at least one passive acoustic silencer;

a microphone;

an electronic control module comprising means of analyzing a signal picked up by the microphone and generating a signal emitted by the loudspeaker, said emitted signal constituting an acoustic counterwave to the signal picked up by the microphone (160, 360).

Thus, the active damping system complements the passive damping system for frequencies below 1000 Hz.

The invention likewise concerns a method for damping the outside noise in an interior room comprising a system of windows according to the invention, characterized in that it involves the steps of:

partly opening the first and second windows;

picking up the outside noise by means of a microphone;

generating an acoustic wave contrary to the signal picked up in a frequency range between 80 Hz and 1000 Hz.

Thus, this method combines the passive damping for elevated frequencies and the active damping for low frequencies, which allows it to be effective for attenuating the outside noise for openings as large as 10 cm to 20 cm for each of said first and second windows.

In one particular embodiment, the first and second windows are respectively opened partly in two parallel and opposite directions. Such an embodiment advantageously allows an attenuation of the outside noise pertaining to the interval of [30 dB, 35 dB] when the windows of the system of windows are partly ajar, thus allowing the user of such a system of windows to benefit from a ventilation without experiencing the nuisance of outside sounds.

PRESENTATION OF THE FIGURES

The invention is explained below according to preferred embodiments, in no way limiting, and making reference to FIGS. 1 to 10, in which.

DETAILED DESCRIPTION OF ONE EMBODIMENT OF THE INVENTION

Figure 1:
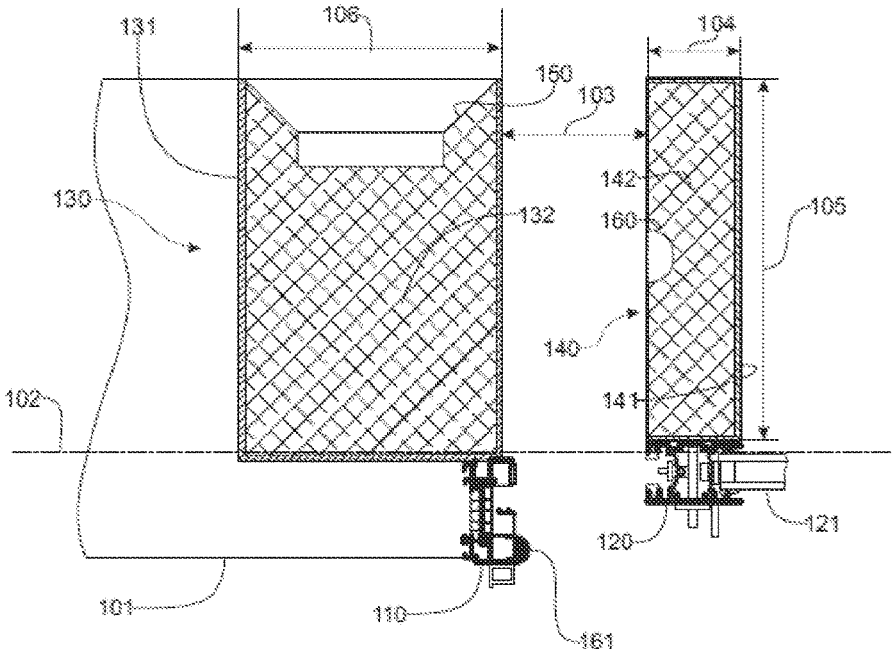
FIG. 1 shows in a partial and schematic view an exemplary embodiment of a window in cross-sectional a horizontal plane perpendicular to the open surface closed by the window.

FIG. 1, according to one embodiment, the window of the invention is a sliding window having a frame body (110) connected to a façade (101), and an opening panel (120) supporting a glazing (121), closing an open surface (102) in said façade (101). According to this exemplary embodiment, the studs of the frame (110) and the opening panel (120) are made of aluminum profiles with thermal bridge rupture, however the invention is adaptable to any type of carpentry. Likewise, the invention is adaptable to every type of opening: sliding, shutter, guillotine.

A first slide (130) is secured to the frame (110) and, according to one exemplary embodiment, this slide (130) is hidden in the wall (101) forming the façade. A second slide (140) is secured to the opening panel (120) facing the first slide (130), so that when the window is partly opened said slides (140, 130) delimit a gap with a thickness (103) equal to this partial opening. According to this exemplary embodiment, each slide is composed of a U-shaped profile (131, 141), for example a profile of aluminum alloy filled with an acoustically absorbent material, such as a porous or fibrous material. According to exemplary embodiments (not represented), the surfaces of the slides (130, 140) are covered by an acoustically transparent coating for esthetic purposes, or the walls of the slides (130, 140) inside the gap are pierced by a plurality of holes each forming a Helmholtz resonator and cooperating with the acoustically absorbent material (132, 142) to dampen certain frequency bands.

According to one exemplary embodiment, the slides (130, 140) extend normal to the open surface (102) for a distance (105) of the order of 25 cm. According to this exemplary embodiment, the slide (140) connected to the opening panel (120) has a thickness (104) of the order of 6 cm. The gap created between the two slides (130, 140) produces an acoustic silencer, effective in the range of medium frequencies, from 1000 Hz to 5000 Hz, when the window is partly ajar with an opening (103) up to 10 cm. Beyond this, the efficacy decreases rapidly with the increasing of the opening.

In order to handle low frequencies, according to one improvement to the window of the invention, an active damping device is installed in the slides (130, 140). This device comprises at least one loudspeaker (150) preferably placed in the slide (130) connected to the frame (110). In fact, this fixed slide (130) is advantageously made with a thickness (106) greater than that of the slide (140) connected to the opening panel, in order to accommodate said loudspeaker there and also possibly the electronic control module (not shown) or other components of this active damping device. According to this exemplary embodiment, the loudspeaker (150) is turned toward the outside of the façade. Alternatively, said loudspeaker is turned toward the gap formed by the two slides (130, 140) when the window is partly ajar. According to this exemplary embodiment, at least one microphone (160) is placed in the slide (140) connected to the opening panel. According to one exemplary embodiment, said microphone (160) is turned toward the gap or toward the outside in order to capture the so-called primary acoustic field, i.e., the one prevailing on the outside. Alternatively or additionally, the primary acoustic field is measured by one or more microphones (161) secured to the body of the frame on the inside. Advantageously, this field is picked up by a plurality of microphones (161) spaced apart by a distance less than or equal to half wavelength of the highest frequency f dampened by the active damping device. According to a nonlimiting example, f=500 Hz.

The primary acoustic field is picked up by the microphone (160, 161) or the plurality of microphones, and the electronic module (not represented) calculates a contrary acoustic wave able to cancel out this primary field. The corresponding electrical signal is amplified and sent to the loudspeaker (150) which broadcasts the secondary acoustic field countering the primary acoustic field. Thus, the active acoustic control device makes it possible to extend the effectiveness of the window of the invention toward the low frequencies. According to one exemplary embodiment, the window of the invention is dimensioned so that the active damping device is mainly effective in the frequency band between 80 Hz and 500 Hz, whereas the passive acoustic silencer formed by the gap between the absorbent slides (130, 140) is mainly effective in the frequency band between 500 Hz and 5000 Hz. The window of the invention advantageously comprises a sensor in the form of a contact (not represented), making it possible to automatically deactivate the active damping device when said window is closed.

The active device assembly is advantageously comprised in one of the two slides (130, 140) or in the two slides (130, 140) so that the slides thus outfitted constitute a kit adaptable to a large number of existing windows.

Figure 2:
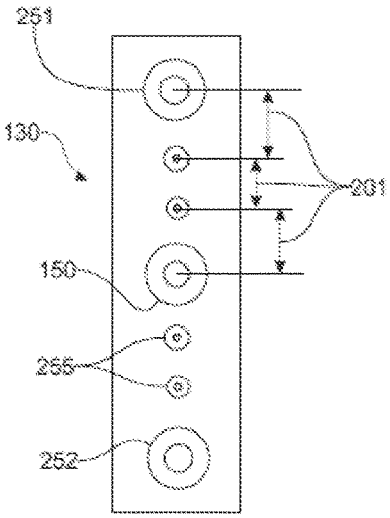
FIG. 2 is a front view, from the outside, of the slide secured to the frame of the window.

FIG. 2, in order to reduce the footprint of the device in the two slides, the active device advantageously uses a plurality of loudspeakers. According to one exemplary embodiment, a reduced number of loudspeakers (150, 251, 252) of large volume is used for the emitting of low frequencies, for example for frequencies below 250 Hz. These loudspeakers of larger volume are for example able to emit in a frequency range between 80 Hz and 10 5000 Hz. A plurality of loudspeakers (255) of reduced size is used for the emitting of higher frequencies in order to densify the secondary field in frequencies greater than 250 Hz. These loudspeakers intended for higher frequencies are for example able to emit a signal in a frequency range between 250 Hz and 5000 Hz. The loudspeakers (250, 251, 252) are arranged with an interval (201) less than or equal to half wavelength of the highest frequency, denoted f, designed for active damping. For example, an interval of 34 cm for a frequency f of 500 Hz.

Figure 3:
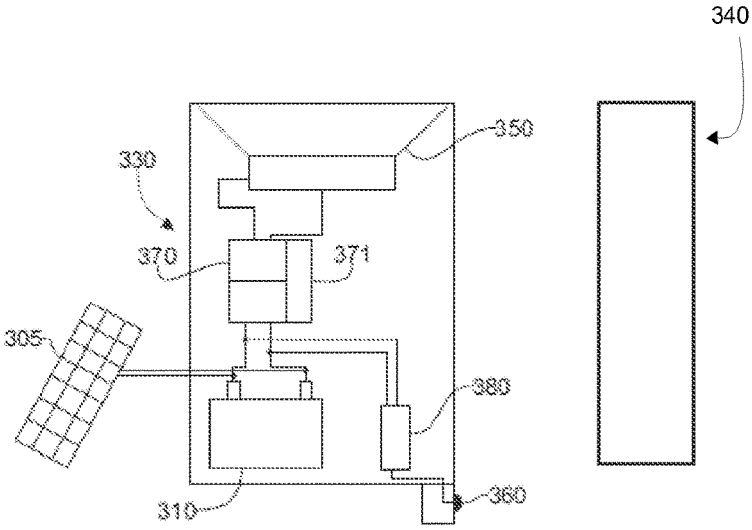
FIG. 3 is a schematic diagram, along the same cross section as FIG. 1, of a window outfitting kit.

FIG. 3, according to one exemplary embodiment, in order to make such a kit autonomous, the electronic control module (370) placed in the slide (330) designed to be secured to the frame is advantageously energized by a battery (310) which is charged by a photovoltaic panel (305) placed appropriately, for example on the façade. The electronic module (370) comprises an input port (371) able to receive a digital signal coming from an acquisition device (380). According to one exemplary embodiment, said digital signal is transmitted from the acquisition device (380) to the electronic module (370) by means of a short-range radio signal, such as that according to one of the protocols WIFI®, Bluetooth® or ZigBee®. A computing module (372) makes it possible to compute a wave contrary to the signal received at said input port (371). An amplification module (373) makes it possible to generate the signal powering the loudspeaker (350) in order to generate the secondary acoustic field. The electronic control module (370) comprises means of tuning to adapt the secondary acoustic field generation to the configuration of the window on which the kit is being used. Advantageously, this tuning is done via the radio interface (371) by using a series of programmed transmissions and measurements, controlling the device through a computer terminal. Thus, the tuning protocol is advantageously programmed for an automatic tuning on an application for a smartphone, for example.

Of course, the invention as described in FIGS. 1, 2 and 3 applies equally to windows having one or two opening panels, as well as one or two passive acoustic silencers, each comprising an active acoustic damping system.

Figure 4:
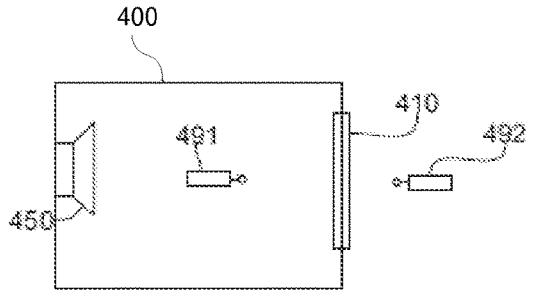
FIG. 4 shows in a schematic cross section view an exemplary embodiment of an experimental device for measuring the efficacy of a window in terms of acoustic attenuation.

FIG. 4, according to one example of an experimental device, an acoustic box (400) is closed by a window (410) according to the invention provided with a damping device by acoustic silencers and an active damping device as described above. Noise is generated inside said box (400), for example by means of a loudspeaker (350). A sound meter (491) is placed inside the box and another sound meter (492) is placed in front of the window (410) outside the box (400). The measurement at a given moment in time of the acoustic power picked up by the two sound meters (491, 492) makes it possible to measure the sound attenuation provided by the window (410) in different configurations.

Figure 5:
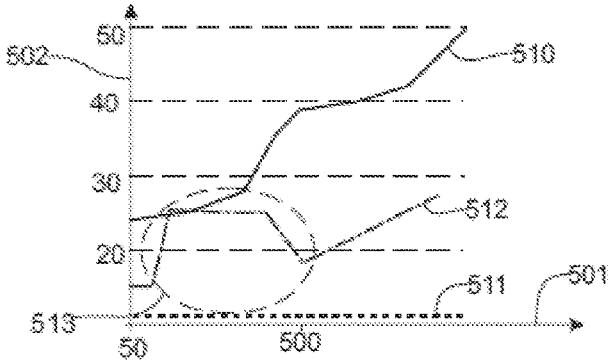
FIG. 5 is a sample diagram of acoustic attenuation obtained by means of the device in FIG. 4.

FIG. 5, the measurement is first of all done with the window closed and shows in a diagram, having as its abscissa (510) the frequency and as its ordinate (502) the attenuation in dB, the attenuation (510) produced by the window when it is closed. A control curve (511) is produced by measuring the attenuation produced by a window not equipped with passive and active damping devices, when that window is partly opened by 10 cm. Finally, the third curve shows the attenuation produced by the window of the invention outfitted with active and passive acoustic damping devices when it is partly opened by 10 cm. This curve (512) clearly shows the zone (513) of effective active damping at frequencies substantially below 500 Hz.

According to another aspect, the invention concerns a system of windows.

Figure 6:
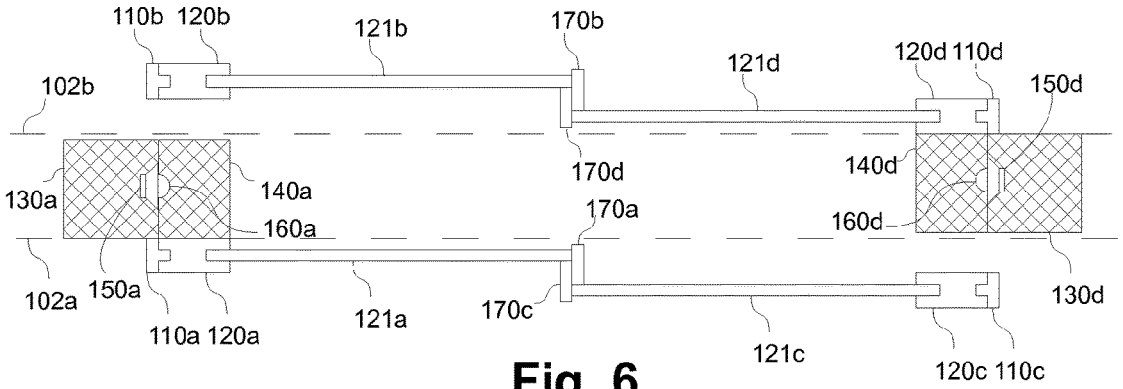
FIG. 6 shows a schematic exemplary embodiment of a system of sliding windows for acoustic damping.

FIG. 6 shows a schematic exemplary embodiment of a system of sliding windows for acoustic damping, said system blocking an open space in a wall separating the inside from the outside.

This open space comprises an internal open surface (102*a*) and an external open surface (102*b*). By internal (102*a*) and external (102*b*) open surfaces is meant surfaces facing respectively the inside and the outside. Moreover, said system comprises a first window and a second window, each window having at least one opening panel (120*a*, 120*b*, 120*c*, 120*d*), known as the end panel, cooperating with a portion of a frame (110*a*, 110*b*, 110*c*, 110*d*). Moreover, each window supports a glazing (121*a*, 121*b*, 121*c*, 121*d*).

The system of windows is configured so that said first and second windows respectively block said internal (102*a*) and external (102*b*) surfaces.

In the rest of the description, we shall employ the convention that the terms left, right, top, front and rear of the system of windows correspond respectively to the terms left, right, top, front and rear for a person facing said first and second windows on the inside. For this purpose, FIG. 6 corresponds to a top view of said system of windows.

In a preferred embodiment, illustrated by FIG. 6 in no way a limiting manner, each of said first and second windows comprises two end panels (120*a*, 120*b*, 120*c*, 120*d*) cooperating respectively with two different portions (110*a*, 110*b*, 110*c*, 110*d*) of the frame of said window. More precisely, each window comprises a right end panel (120*c*, 120*d*) and a left end panel (120*a*, 120*b*), said right end panel (120*c*, 120*d*) (respectively left end panel (120*a*, 120*b*)) being configured to slide along, and in front of, said left end panel (120*a*, 120*b*) (respectively right end panel (120*c*, 120*d*)). Moreover, the relative movement of the right end panel (120*c*, 120*d*) of a window with respect to the left end panel (120*a*, 120*b*) of that window is limited by abutment means (170*a*, 170*b*, 170*c*, 170*d*), such as two rods mounted fixed to said right (120*c*, 120*d*) and left (120*a*, 120*b*) end panels, respectively, and adapted to cooperate with each other. Moreover, the frame of each window comprises a right vertical portion (110*c*, 110*d*) and a left vertical portion (110*a*, 110*b*), said right end panel (120*c*, 120*d*) (respectively left end panel (120*a*, 120*b*)) being adapted to cooperate with said right portion (110*c*, 110*d*) of the frame (said left portion (110*a*, 110*b*) of the frame).

However, nothing prevents us from having windows configured so that their respective right end panels slide behind their respective left end panels.

The system of windows is also configured so that at least one of said first and second windows has at least one passive acoustic silencer comprising two parallel and acoustically absorbent slides (130*a*, 140*a*, 130*b*, 140*b*, 130*c*, 140*c*, 130*d*, 140*d*), extending in a median plane normal to the internal (102*a*) and external (102*b*) surfaces, one being secured to said at least one end panel (120*a*, 120*b*, 120*c*, 120*d*) and the other being secured to the portion of the frame (110*a*, 110*b*, 110*c*, 110*d*) connected to said at least one end panel (120*a*, 120*b*, 120*c*, 120*d*), the displacement of said at least one end panel (120*a*, 120*b*, 120*c*, 120*d*) in relation to the frame (110*a*, 110*b*, 110*c*, 110*d*) creating between said slides a gap with a thickness (103) equal to the opening of the window.

In the rest of the description, said at least one passive acoustic silencer of said system of windows comprises one or more of the characteristics, taken alone or in any technically possible combination, of the passive acoustic silencer described above in the case of a single window having a single passive acoustic silencer, and illustrated as an in no way limiting example by FIGS. 1, 2 and 3. Thus, the exemplary embodiments described below are in no way limiting.

Preferably, each of said first and second windows has a passive acoustic silencer, the slides of the passive acoustic silencers of the first window and of the second window respectively extending in two different median planes. For example, and as illustrated by FIG. 6 in no way a limiting manner, the first window (respectively the second window) comprises a passive acoustic silencer comprising two slides (130*a*, 140*a*) (respectively (130*d*, 140*d*)) secured respectively to the left end panel (120*a*) (respectively the right end panel (120*d*)) and to the left frame (110*a*) (respectively right frame (110*d*)) of said first window (respectively second window).

Such a configuration is advantageous because it enables better effectiveness of the acoustic damping of the noise coming from the outside as compared to a configuration having a single window comprising one passive acoustic silencer. In fact, when the first and second windows are partly ajar, for example respectively by 10 cm, in the area of their respective passive acoustic silencers, the noise first of all undergoes a first acoustic damping by passing between the slides (130*d*, 140*d*) of the passive acoustic silencer of the second window. The dampened noise, leaving the passive acoustic silencer of the second window, then undergoes a second acoustic damping by passing between the slides (130*a*, 140*a*) of the passive acoustic silencer of the first window. Furthermore, said two median planes being different, when said windows are partly ajar in the area of their respective passive acoustic silencers, the path of the noise in penetrating from the outside to the inside constitutes a maze. For example, and as illustrated in FIG. 6, the noise enters on the right side of the second window, and leaves dampened from the left side of the first window. This maze effect also helps to increase the noise reduction between the outside and the inside by making the path traveled by the noise more complex than a configuration where the two windows are open on the same side.

However, nothing prevents us from having other configurations, such as a first window and a second window each having two end panels, said first window having a passive acoustic silencer on the right side, and said second window having a passive acoustic silencer on the left side.

Furthermore, the system of windows is configured so that at least one passive acoustic silencer also comprises an active acoustic damping system comprising:

- a loudspeaker (150, 251, 252, 255, 350) placed in one of the slides of said at least one passive acoustic silencer;
- a microphone (160, 360);
- an electronic control module (370) comprising means of analyzing a signal picked up by the microphone (160, 360) and generating the signal emitted by the loudspeaker, said emitted signal constituting an acoustic counter-wave to the signal picked up by the microphone (160, 360).

In the rest of the description, said active acoustic damping system comprises one or more of the characteristics, taken alone or in any technically possible combination, of the active acoustic system described above in the case of a single window having a single active acoustic system, and illustrated as an in no way limiting example by FIGS. 1, 2 and 3.

In the example illustrated in no way a limiting manner by FIG. 6, the passive acoustic silencers of the first and second windows respectively each comprise an active acoustic damping system. The active damping system of the first window (respectively the second window) comprises a loudspeaker (150*a*) (respectively (150*d*)) turned toward the gap formed by the two slides (130*a*, 140*a*) (respectively (130*d*, 140*d*)) when said first window (respectively second window) is partly ajar. According to this exemplary embodiment, a microphone (160*a*) (respectively (160*d*)) is placed in the slide (140*a*) (respectively (140*d*)) connected to the left end panel (120*a*) of the first window (respectively right end panel (120*d*) of the second window).

Figure 7:
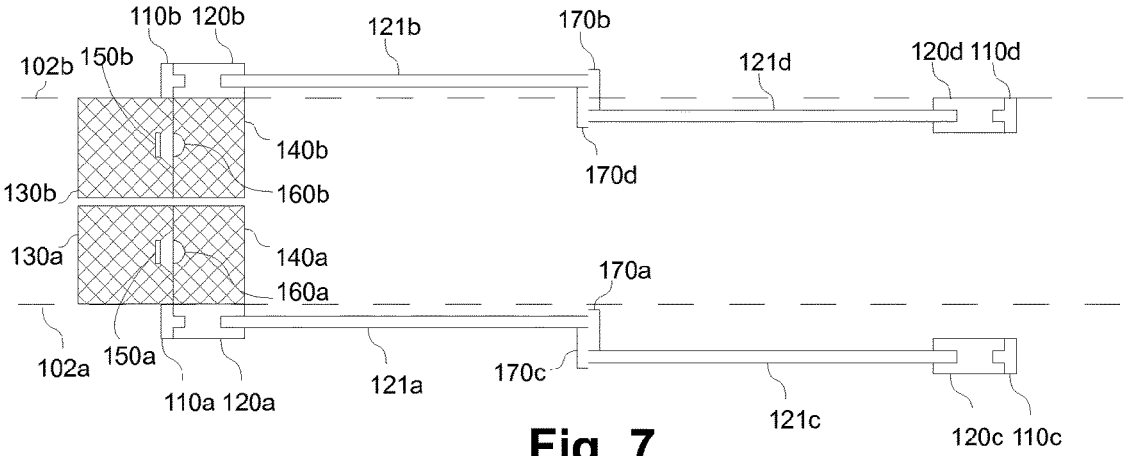
FIG. 7 shows schematically a variant embodiment of the system of windows of FIG. 6, in which the slides of the passive acoustic silencers extend in a common median plane.

FIG. 7 represents schematically a variant embodiment of the system of windows of FIG. 6, in which each of said first and second window comprises a passive acoustic silencer comprising an active damping system, the slides (130*a*, 140*a*, 130*b*, 140*b*) of the passive acoustic silencers of the first window and of the second window respectively extending in a common median plane. For example, the first window (respectively the second window) comprises a passive acoustic silencer comprising two slides (130*a*, 140*a*) (respectively 130*b*, 140*b*) respectively secured to the right end panel (120*a*) and to the right frame (110*a*) of said first window (respectively to the left end panel (120*b*) and to the left frame (110*b*) of said second window). Moreover, the active damping systems of the first window and of the second window respectively each have a loudspeaker (150*a*, 150*b*) and a microphone (160*a*, 160*b*) configured like those of FIG. 6. Such a configuration of the system of windows enables better effectiveness of the acoustic damping of the noise coming from the outside as compared to a configuration having a single window comprising one passive acoustic silencer (as described for example in FIG. 1), but nevertheless it offers less performance than a system of windows comprising two passive acoustic silencers respectively outfitted with active damping systems, and in which the median planes containing the slides (130*a*, 140*a*, 130*b*, 140*b*) of the first and second windows are different. This is due in particular to the fact that the path of the noise from the outside to the inside does not include a maze.

Figure 8:
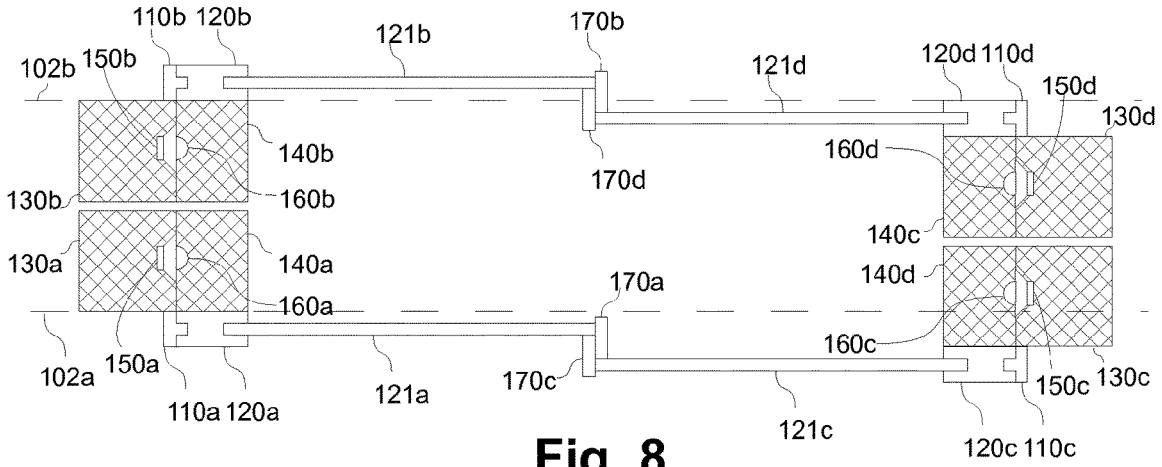
FIG. 8 shows schematically a particular embodiment of the system of windows of FIG. 6 or FIG. 7, in which each window comprises a first and a second passive acoustic silencer.

FIG. 8 shows schematically a particular embodiment of the system of windows of FIG. 6 or FIG. 7, in which each window has a first and a second passive acoustic silencer, the slides (130*a*, 140*a*, 130*b*, 140*b*) of the first passive acoustic silencer of the first window and of the first passive acoustic silencer of the second window respectively extending in a first common median plane, on the left side, and the slides (130*c*, 140*c*, 130*d*, 140*d*) of the second passive acoustic silencer of the first window and of the second passive acoustic silencer of the second window respectively extending in a second common median plane, on the right side. Hence, it will be understood that said first and second common median planes are different. Furthermore, each of said passive acoustic silencers comprises an active damping system including a loudspeaker (150*a*, 150*b*, 150*c*, 150*d*) and a microphone (160*a*, 160*b*, 160*c*, 160*d*) configured like those in FIG. 6. Such a configuration advantageously allows an optimal reduction in the noise coming from the outside when the first and second windows are respectively open in two parallel and opposite directions in order to produce a maze for the path of the noise between the windows. Moreover, such a configuration also affords the user the possibility of opening the first and second windows on the same side in order to prioritize, for example, an increased ventilation at the expense of reduced acoustic performance.

However, nothing prevents us from having other configurations with a different number of passive acoustic silencers and active damping systems. For example, according to an example not detailed here, the first window has two passive acoustic silencers positioned on the end panels, respectively right and left, of said first window, and the second window has a single passive acoustic silencer positioned on the right or left end panel of said second window.

In one variant embodiment of the system of windows of FIG. 6 (not represented), an intermediate panel is positioned, in a way known to the skilled person, between the two end panels (120*a*, 120*c*) of the first window (respectively the two end panels (120*b*, 120*d*) of the second window). Such a configuration is advantageous when the respective sizes of said internal and external surfaces are large. In other words, the system of windows is adaptable to any size of open space in a wall.

Figure 9:
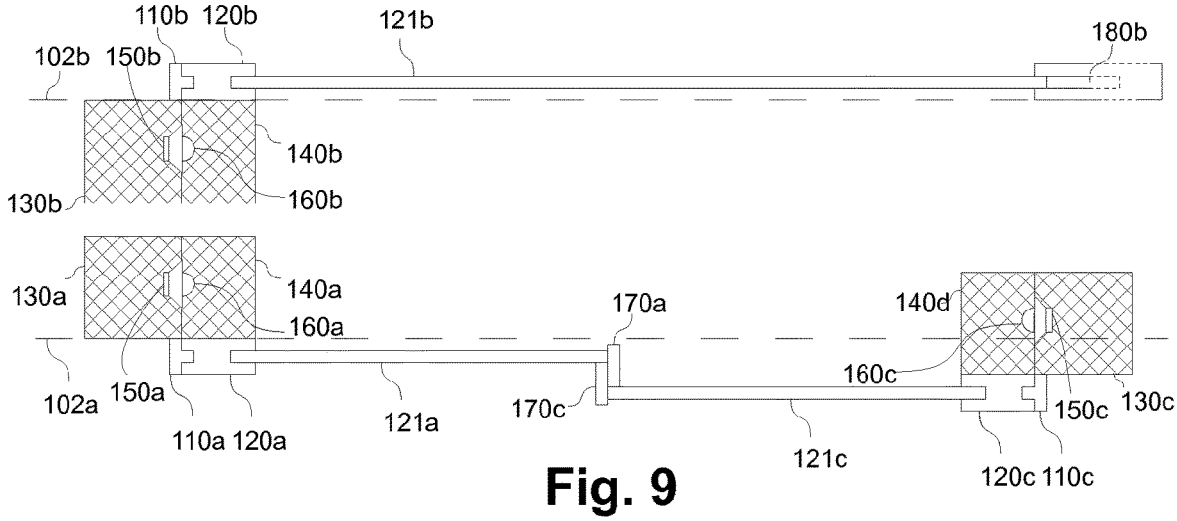
FIG. 9 shows schematically a variant embodiment of the system of windows in which the first window comprises two end panels and in which the second window comprises a single end panel.

FIG. 9 shows schematically a variant embodiment of the system of windows in which the first window has two end panels (120*a*, 120*c*) cooperating respectively with the left (110*a*) and right (110*c*) portions of its frame, and in which the second window has a single end panel (120*b*) cooperating with the left portion (110*b*) of its frame. Moreover, each end panel (120*a*, 120*c*) of said first window has a passive acoustic silencer comprising an active damping system. As for said second window, this is configured such that it opens in a prolongation of said external surface (102*b*) by sliding in an opening (180*b*) of the wall, said opening (180*b*) being positioned on the right side of the window. Moreover, said second window has a passive acoustic silencer comprising an active damping system on the left side. Each active damping system comprises a loudspeaker (150*a*, 150*b*, 150*c*) and a microphone (160*a*, 160*b*, 160*c*) configured like those of FIG. 6.

Figure 10:
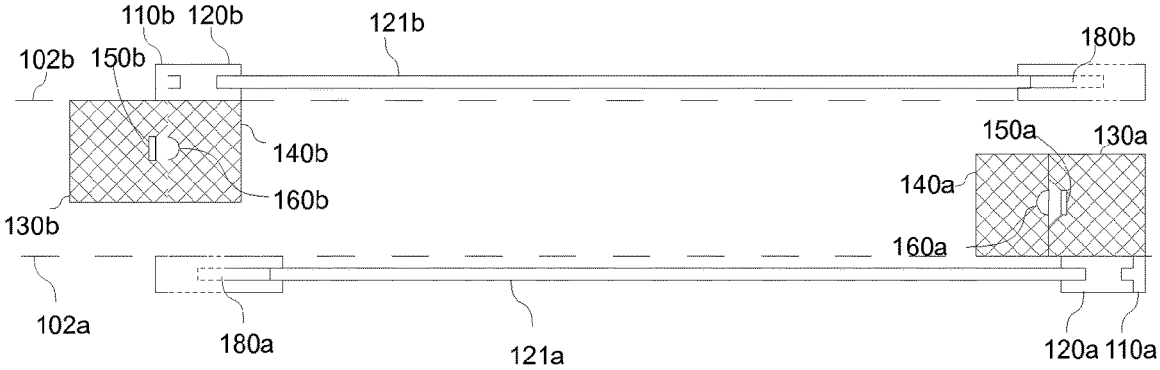
FIG. 10 shows schematically a variant embodiment of the system of windows in which each of said first and second windows comprises a single end panel.

FIG. 10 shows schematically a variant embodiment of the system of windows in which each of said first and second windows has a single end panel (120*a*, 120*b*). The first window (respectively the second window) is configured so that it opens in the prolongation of said internal surface (102*a*) (respectively external surface (102*b*)) by sliding in an opening (180*a*) (respectively (180*b*)) of the wall, said opening (180*a*) (respectively (180*b*)) being positioned on the left side of said first window (respectively on the right side of said second window). Moreover, said first window (respectively second window) has a passive acoustic silencer comprising an active damping system on the right side (respectively the left side), but nothing prevents said passive acoustic silencer of the first window being on the left side (respectively that of the second window on the right side). Each active damping system comprises a loudspeaker (150*a*, 150*b*) and a microphone (160*a*, 160*b*) configured like those of FIG. 6.

We note that in an alternative embodiment, it is of course possible to have a system of windows in which only the first window (respectively the second window) has at least one passive acoustic silencer, said at least one passive acoustic silencer preferably comprising an active acoustic silencer.

The present invention likewise concerns a method for the damping of outside noise in an interior room comprising a system of windows as described above.

For this, the method involves a first step consisting in opening the first and second windows.

In one preferred embodiment of said first step, the first and second windows are respectively opened in two parallel and opposite directions, so as to impose on the outside noise a path including a maze before arriving in the interior room.

In a second step, the outside noise is picked up by means of a first microphone (160, 360) and a second microphone respectively of the first and second windows.

Then, in a third step, an acoustic wave contrary to the signal picked up is generated in a frequency range between 80 Hz and 1000 Hz.

It should be noted that the kit described above, and illustrated in no way a limiting manner by FIG. 3, in the case of the embodiment of a single window with acoustic damping, is clearly adaptable to a system of windows having a plurality of end panels. Such a kit is then used for each of said end panels.

The above description and the exemplary embodiments show that the invention achieves the stated purpose, and makes it possible to obtain an attenuation of outside noise pertaining to the interval of [30 dB, 35 dB] when the windows of the system of windows are partly ajar, thus allowing the user of such a system of windows to enjoy a ventilation without experiencing annoying outdoor sounds. Furthermore, the system also enables an excellent attenuation of the outdoor noise pertaining to the interval of [40 dB, 50 dB] when the windows of the system of windows are closed.

The invention claimed is:

1. A window to block an open surface in a wall separating an inside from an outside, comprising a sash; a frame; and a passive acoustic silencer comprising two acoustically absorbent parallel panels/plates, each extending by 25 cm in a direction normal to the open surface, a first acoustically absorbent parallel panel/plate is secured to the sash and extends outward from the sash, a second acoustically absorbent parallel panel/plate is secured to the frame and extends outward from the frame, a displacement of the sash with respect to the frame creates a gap between the two acoustically absorbent parallel panels/plates, the gap being equal to an opening of the window, the passive acoustic silencer provides an acoustic dampening that is inversely proportional to the gap and proportional to the 25 cm extension of the two acoustically absorbent parallel panels/plates.

2. The window as claimed in claim 1, wherein each of the two acoustically absorbent parallel panels/plates comprises a U-shaped profile applied against a body of the sash or a body of the frame and filled with an acoustic absorbent material.

3. The window as claimed in claim 1, further comprising an active acoustic damping system comprising: a loudspeaker placed in one of the two acoustically absorbent parallel panels/plates; a microphone; and an electronic controller to analyze a first signal picked up by the microphone and to generate a second signal emitted by the loudspeaker, the second signal constituting an acoustic counterwave to the first signal picked up by the microphone.

4. The window as claimed in claim 3, wherein the microphone is placed in the first acoustically absorbent parallel panel/plate connected to the sash and the loudspeaker is placed in the second acoustically absorbent parallel panel/plate connected to the frame.

5. The window as claimed in claim 3, wherein the microphone is secured to the frame on the inside.

6. The window as claimed in claim 3, wherein the loudspeaker is placed in the second acoustically absorbent parallel panel/plate connected to the frame and turned toward the outside.

7. The window as claimed in claim 3, wherein the loudspeaker is placed in the second acoustically absorbent parallel panel/plate connected to the frame and turned toward the first acoustically absorbent parallel panel/plate connected to the sash.

8. The window as claimed in claim 3, further comprising a plurality of loudspeakers; wherein a first set of speakers from said plurality of loudspeakers are configured to emit a signal in a frequency interval extending into frequencies below 250 Hz; and wherein a second set of speakers from said plurality of speakers are configured to emit an acoustic signal of frequency higher than 250 Hz.

9. The window as claimed in claim 5, further comprising a plurality of microphones; wherein the active acoustic damping system is configured to generate an active damping up to a maximum frequency f, and wherein said plurality of microphones are secured to the frame on the inside, said plurality of microphones are spaced by a distance less than or equal to half wavelength corresponding to the maximum frequency f.

10. The window as claimed in claim 8, wherein the active acoustic damping system is configured to generate an active damping up to a maximum frequency f, and wherein said plurality of loudspeakers are spaced by an interval less than or equal to half wavelength corresponding to the maximum frequency f.

11. A method for damping an outside noise in an interior room comprising the window as claimed in claim 3, comprising steps of:

picking up the outside noise with an aid of the microphone; and generating an acoustic wave contrary to the first signal picked up in a frequency range between 80 Hz and 1000 Hz.

12. A prefabricated assembly or kit, comprising:

a first panel/plate configured to be secured to a sash of a window, the first panel/plate comprising a U-shaped profile filled with an acoustic absorbent material and a microphone;

a second panel/plate configured to be secured to a frame of a window, the second panel/plate comprising a U-shaped profile filled with the acoustic absorbent material and a loudspeaker;

an electronic controller configured to receive a first signal from the microphone and to generate and transmit a second signal to the loudspeaker to cancel the first signal, thereby providing an active damping system; and an electrical power supply to supply an electrical power to the electronic controller.

13. The prefabricated assembly as claimed in claim 12, further comprising a photovoltaic panel connected to the electrical power supply.

14. A system of windows for acoustic damping, the system blocks an open space in a wall separating an inside from an outside, the open space comprising an open internal surface and an open external surface, the system comprising:

a first window and a second window as claimed in claim 1, each window comprising a frame and at least one sash or end panel, said at least one sash or end panel cooperating with a portion of the frame;

wherein the first and second windows block the internal and external surfaces, respectively;

wherein each of the first and second windows comprises at least one passive acoustic silencer, said at least one passive acoustic silencer comprising two acoustically absorbent parallel panels/plates extending in a median plane normal to the internal and external surfaces, a first acoustically absorbent parallel panel/plate is secured to said at least one sash or end panel and a second acoustically absorbent parallel panel/plate is secured to the portion of the frame connected to said at least one sash or end panel, a displacement of said at least one sash or end panel with respect to the frame creates a gap between the two acoustically absorbent parallel panels/plates, the gap being equal to an opening of a corresponding window.

15. The system as claimed in claim 14, wherein at least one of the first and second windows comprises two end panels cooperating respectively with two distinct portions of a corresponding frame.

16. The system as claimed in claim 14, wherein each window comprises two end panels cooperating respectively with two distinct portions of the frame of said each window.

17. The system as claimed in claim 15, wherein the two acoustically absorbent parallel panels/plates of each window extend respectively in two distinct median planes, so that when said each window is a partly ajar in an area of the passive acoustic silencer, a path of a noise penetrating from the outside to the inside constitutes a maze.

18. The system as claimed in claim 15, wherein the two acoustically absorbent parallel panels/plates of each window extend respectively in a common median plane.

19. The system as claimed in claim 16, wherein each window comprises a first passive acoustic silencer and a second passive acoustic silencer, the two acoustically absorbent parallel panels/plates of the first passive acoustic silencer of the first window and the two acoustically absorbent parallel panels/plates Glides of the first passive acoustic silencer of the second window respectively extend in a first common median plane, the two acoustically absorbent parallel panels/plates of the second passive acoustic silencer of the first window and the two acoustically absorbent parallel panels/plates of the second passive acoustic silencer of the second window respectively extend in a second common median plane, the first and second common median planes being different.

20. The system as claimed in claim 15, further comprising at least one intermediate sash positioned between the two end panels of said each window.

21. The system as claimed in claim 14, wherein said at least one passive acoustic silencer of said each window comprises an active acoustic damping system comprising: a loudspeaker placed in one of the two acoustically absorbent parallel panels/plates; a microphone; and an electronic controller to analyze a first signal picked up by the microphone and to generate a second signal emitted by the loudspeaker, the second signal constituting an acoustic counterwave to the first signal picked up by the microphone.

22. A method for damping an outside noise in an interior room comprising a system of windows as claimed in claim 21, comprising steps of:

opening the first and second windows;

picking up the outside noise with an aid of at least one microphone; and generating an acoustic wave contrary to the first signal picked up in a frequency range between 80 Hz and 1000 Hz.

23. The method as claimed in claim 22, wherein the first and second windows are opened respectively in two parallel and opposite directions.

24. The prefabricated assembly as claimed in claim 12, wherein the active acoustic damping system is configured to generate an active damping up to a maximum frequency f, and further comprising a plurality of microphones spaced by an interval less than or equal to half wavelength corresponding to the maximum frequency f.

25. The prefabricated assembly as claimed in claim 12, wherein the active acoustic damping system is configured to generate an active damping up to a maximum frequency f, and further comprising a plurality of loudspeakers spaced by an interval less than or equal to half wavelength corresponding to the maximum frequency f.

* * * * *